US009032768B2

(12) United States Patent
Hauer

(10) Patent No.: US 9,032,768 B2
(45) Date of Patent: May 19, 2015

(54) ACTUATOR FOR MOVABLE FURNITURE PARTS

(75) Inventor: Christian Hauer, Hörbranz (AT)

(73) Assignee: JULIUS BLUM GMBH, Hochst (AT)

( * ) Notice: Subject to any disclaimer, the term of this patent is extended or adjusted under 35 U.S.C. 154(b) by 583 days.

(21) Appl. No.: 13/094,001

(22) Filed: Apr. 26, 2011

(65) Prior Publication Data

US 2011/0197639 A1 Aug. 18, 2011

Related U.S. Application Data

(63) Continuation of application No. PCT/AT2009/000348, filed on Sep. 7, 2009.

(30) Foreign Application Priority Data

Nov. 19, 2008 (AT) ..... A 1798/2008

(51) Int. Cl.

| | |
|---|---|
| ***E05F 1/10*** | (2006.01) |
| ***G05G 5/00*** | (2006.01) |
| ***E05D 15/26*** | (2006.01) |
| ***E05D 15/40*** | (2006.01) |
| *A47B 97/00* | (2006.01) |

(52) U.S. Cl.

CPC ..... *E05F 1/1058* (2013.01); *E05D 15/262* (2013.01); *E05D 15/401* (2013.01); *E05Y 2201/22* (2013.01); *E05Y 2201/622* (2013.01); *E05Y 2900/20* (2013.01)

(58) Field of Classification Search

USPC ..... 70/91, 93, 174, 192, 193, 196; 312/319.2, 325, 327, 328; 292/1, 262, 292/DIG. 15

See application file for complete search history.

(56) References Cited

U.S. PATENT DOCUMENTS

| | | | | |
|---|---|---|---|---|
| 2,557,735 | A * | 6/1951 | Fox | 312/325 |
| 3,301,479 | A * | 1/1967 | Clary et al. | 312/183 |
| 3,666,214 | A * | 5/1972 | Matuska | 312/328 |
| 4,552,418 | A * | 11/1985 | Sarnezki et al. | 312/325 |
| 5,247,877 | A * | 9/1993 | Beard et al. | 312/325 |

(Continued)

FOREIGN PATENT DOCUMENTS

| | | |
|---|---|---|
| AT | 8702 | 11/2006 |
| CN | 1244621 | 2/2000 |

(Continued)

OTHER PUBLICATIONS

International Search Report issued Nov. 26, 2009 in International (PCT) Application No. PCT/AT2009/000348.

Austrian Patent Office Search Report issued Sep. 9, 2009 in corresponding Austrian Patent Application No. A 1798/2008.

Chinese Search Report (SR) issued May 22, 2013 in counterpart Chinese Application No. 200980144190.1.

*Primary Examiner* — Christopher Boswell

(74) *Attorney, Agent, or Firm* — Wenderoth, Lind & Ponack, L.L.P.

(57) ABSTRACT

A device includes an actuating device, and the actuating device includes: a locking device having a lock; an actuating member which pivots about an axis of rotation to move a movable furniture part; and a spring device which biases the actuating member to pivot about the axis of rotation in an opening direction. The lock is lockable by a key for preventing the actuating member from pivoting about the axis of rotation, and the lock is unlockable by the key for enabling the actuating member from pivoting about the axis of rotation.

19 Claims, 6 Drawing Sheets

(56) References Cited

U.S. PATENT DOCUMENTS

| | | | | |
|---|---|---|---|---|
| 5,371,344 | A * | 12/1994 | Buie et al. | 235/1 R |
| 5,474,372 | A * | 12/1995 | Jung | 312/319.2 |
| 6,243,988 | B1 | 6/2001 | Salice | |
| 7,562,757 | B2 * | 7/2009 | Dubach et al. | 312/319.2 |
| 7,735,943 | B2 * | 6/2010 | Hottmann | 312/401 |
| 7,874,043 | B2 | 1/2011 | Salice | |
| 2002/0113532 | A1 * | 8/2002 | Hornberger et al. | 312/323 |
| 2004/0181903 | A1 | 9/2004 | Salice | |
| 2004/0200034 | A1 | 10/2004 | Salice | |
| 2008/0121490 | A1 | 5/2008 | Dubach et al. | |
| 2008/0122332 | A1 * | 5/2008 | Brustle | 312/319.2 |

FOREIGN PATENT DOCUMENTS

| | | |
|---|---|---|
| CN | 1550632 | 12/2004 |
| CN | 1570339 | 1/2005 |
| CN | 1906371 | 1/2007 |
| WO | 94/16417 | 7/1994 |
| WO | 2006/069412 | 7/2006 |

* cited by examiner

ACTUATOR FOR MOVABLE FURNITURE PARTS

This application is a continuation application of International application No. PCT/AT2009/000348, filed Sep. 7, 2009, the entire disclosure of which is incorporated herein by reference.

BACKGROUND OF THE INVENTION

Field of the Invention

The present invention concerns an actuating device with at least one actuating member for moving a movable furniture part and a locking device for inhibiting a movement of the actuating member.

The invention further concerns an article of furniture having at least one actuating device of the kind to be described.

Such actuating devices are fixed in particular to the carcass of an article of furniture, wherein the actuating device is provided to move an upwardly movable flap.

BRIEF SUMMARY OF THE INVENTION

It is an object of the present invention to propose an actuating device of the kind referred to in the opening part of this specification, which allows a controlled movement of the actuating member.

According to the invention, the object is achieved in that the locking device has a lock which is arranged in or on the actuating device and which is unlockable by a key for enabling the movement of the actuating member.

In a first aspect of the invention, only an authorized person (or possibly also a plurality of authorized persons) is allowed access to the possibility of moving the actuating member. The lock can be both unlocked by the key and also—if desirable—locked.

If the actuating device is pre-fitted in or on the article of furniture and the movement of the actuating member is to be inhibited in the closed position of the movable furniture part, it may be desirable to provide on the article of furniture a through opening which allows the key to be fitted through from a position outside the article of furniture into the lock arranged on or in the actuating device. It will be appreciated that it is also in accordance with the invention to use a key-lock system which functions in contact-less fashion. For that purpose the key can include for example an electronic data set and/or a contact-lessly operating RFID transponder.

A further aspect of the invention provides that the proposed locking device with the lock and the key is used as an assembly securing means for the "vacant" actuating member, in which case therefore a movable furniture part—in particular an upwardly movable furniture flap—is not yet fitted to the actuating member. Those actuating devices serve to move a furniture flap fitted to the pivotably mounted actuating member (in particular an actuating arm) between a vertical position of closing a compartment in a carcass of an article of furniture, and an upwardly moved open position. A spring device or a gas compression storage means is used to compensate for the weight of the flap, in which case the torque acting on the actuating member can be selectively adjusted to the weight of the furniture flap to be moved. In the case of heavy furniture flaps therefore a relatively high torque is to be provided as the biasing force for the actuating arm. If however a furniture flap has not yet been pivotally connected to the actuating arm, there is a serious risk that the actuating arm can move rapidly upwardly severely in the opening direction under the force of the spring device acting thereon, and can thereby injure the fitting personnel. WO 2006/069412 A1 to the present applicant already discloses a fitting securing means for the "vacant" actuating arm—on which therefore a furniture flap has not yet been fitted—which has a latching and/or braking device for limiting the opening speed of the vacant actuating arm.

The spring device acts on the actuating member—which is preferably pivotable about a horizontal axis—in the opening direction, and there is a considerable risk of injury caused by an actuating member which strikes out upwardly, when the flap has not yet been fitted. Accordingly, the present invention allows the actuating member to be arrested in its completely open position by the locking device having the lock and the key. The actuating member cannot therefore be moved against the force applied by the spring device, by virtue of the locking action. That permits the flap to be fitted without any problem to the actuating member which is arrested in the completely open position.

In an embodiment of the invention it can be provided that the key is secured by a releasable holding device on or in the actuating device and the releasable holding device releases the key only after the flap has been fitted to the actuating member. In other words the key is available to release the locking action only when the flap has been properly fitted to the actuating member. When the flap is securely fixed to the actuating member then the risk of an actuating member lashing out upwardly is also substantially eliminated. It is only after the flap has been fitted that the releasable holding device releases the key, whereupon the locking device can be unlocked and then the actuating member is movable unimpededly between a closed position and an open position.

In accordance with an additional safety aspect of the invention it can be provided that the key unlocks the locking device only as long as the key is fitted in the lock. In other words the actuating member is freely movable only with a key fitted in the lock. When the key is removed from the lock, the locking device can automatically block a movement of the actuating member.

The actuating device usually has a power path which in the simplest case includes the actuating member and the spring device acting on the actuating member. In that case the locking device locks at least one element of that power path, that is to say the spring device and/or the actuating member. It will be appreciated that it is also possible for the power path to have a transmission mechanism (either a lever mechanism and/or a gear assembly), which acts between the spring device and the actuating member, wherein at least one element of the transmission mechanism is lockable by the locking device. In this connection it can be provided that the locking device has at least one arresting element by which the element of the power path is lockable relative to a part which is fixed with respect to the article of furniture—preferably the housing of the actuating device. In that respect it may be desirable if the arresting element is movable by the key from a position of arresting the element of the power path into a release position in which the arresting element is unlocked from the element of the power path.

BRIEF DESCRIPTION OF THE DRAWINGS

Further details and advantages of the present invention will be described by means of the specific description hereinafter, which reference to the figures in which.

DETAILED DESCRIPTION OF THE INVENTION

Figure 1A:
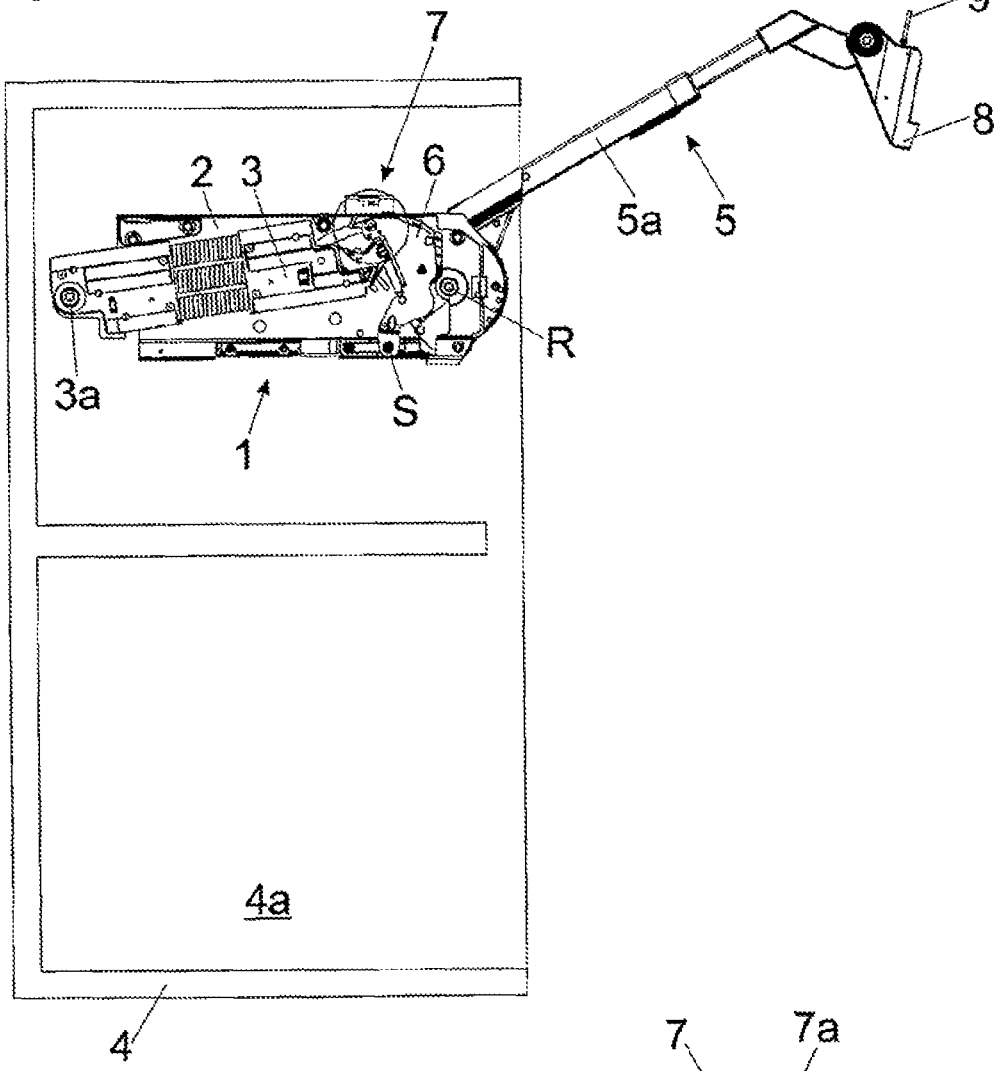
FIGS. 1*a*, 1*b* show a side view of an actuating device mounted to a furniture carcass for moving an upwardly movable furniture flap, wherein the actuating member of the actuating device is arrested in the completely open position by a locking device, and an enlarged detail view thereof.

FIG. 1*a* shows a side view of an actuating device 1 according to the invention having a housing 2 which is pre-fitted to a side wall 4*a* of a furniture carcass 4. The actuating device 1 in known fashion has a spring device 3 which is supported on the one hand against a mounting 3*a*, which is fixed with respect to the article of furniture, on the housing 2, and which on the other hand acts on the actuating member 5 in the form of an actuating arm 5*a*, about the axis of rotation R, in the opening direction. Arranged between the spring device 3 and the actuating arm 5*a* is a transmission mechanism in the form of an intermediate lever 6 (movable element) mounted pivotably about an axis of rotation S. It is also possible to see a locking device 7 which in the illustrated embodiment locks the intermediate lever 6 and inhibits it from a pivotal movement about the axis of rotation S. The actuating member 5 in the form of the actuating arm 5*a* can be arrested in its completely open position by locking of a movable element of the transmission mechanism in the power path (in the present case the intermediate lever 6). That locking device 7 is therefore part of a fitting securing means for the "vacant" actuating arm 5*a* to which therefore no furniture flap is pivotably connected. Locking of the actuating arm 5*a* in its completely open position means that it cannot be urged in the direction of the closed position. That has the advantage on the one hand that a furniture flap can be connected without any problem to the actuating arm 5*a* which is arrested and thus held in a stable condition. On the other hand the actuating arm 5*a* can also not be urged in the direction of the closed position as—in particular due to lack of attention—it can uncontrolledly slip out of an intermediate position preceding the completely open position and by virtue of the extremely high prestressing forces of the spring device 3 can move rapidly back into the completely open position again and as a result can cause massive injury. The actuating member 5 in the form of the actuating arm 5*a* has a fixing device 8 for releasable connection to a fitment at the hinge side (not shown), whereby a furniture flap can be connected to the actuating arm 5*a*. It is also possible to see a diagrammatically illustrated key 9 which is secured by a releasable holding device on or in the fixing device 8. The key 9 which is necessary for unlocking the locking device 7 cannot however be removed when the flap is not fitted in place. The key 9 can only be released from the fixing device 8 when a flap is properly connected to the fixing device 8. It is only after the flap has been fitted to the actuating arm 5*a* that the key 9 is released and can then be passed to the locking device 7, whereby the locking action is releasable and the actuating arm 5*a* is pivotable between the closed position and the open position.

Figure 1B:
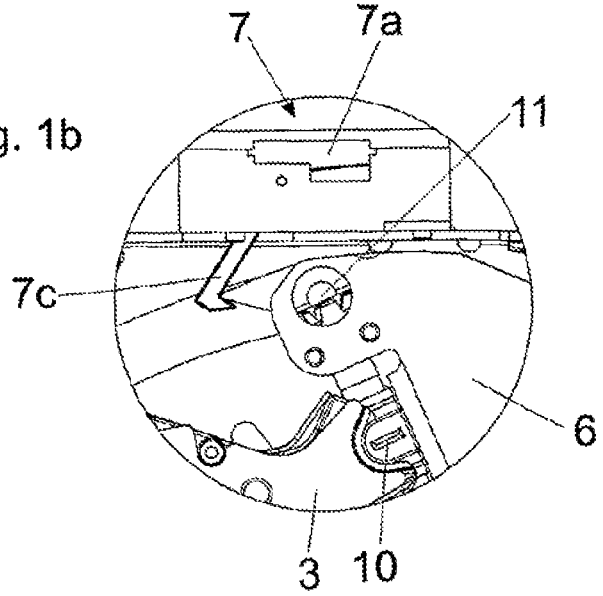

FIG. 1*b* shows an enlarged view of the region circled in FIG. 1*a*. It is possible to see the pivotable intermediate lever 6 which is acted upon by the spring device 3. The spring device 3 presses against the intermediate lever 6 at a spring mounting 10, wherein the position of the spring mounting 10 is variably adjustable by an adjusting device 11 relative to the intermediate lever 6. In that way the force of the spring device 3 can be selectively adjusted to the weight of the flap which is still to be mounted in place. The locking device 7 includes a lock 7*a* into which the key 9 can be inserted after the flap has been fitted (at a right angle to the plane of the drawing), whereby the arresting element 7*c* of the locking device 7 is unlockable from the intermediate lever 6. When the arresting element 7*c* is released from the intermediate lever 6 the actuating arm 5*a* can also move unimpededly again.

Figure 2A:
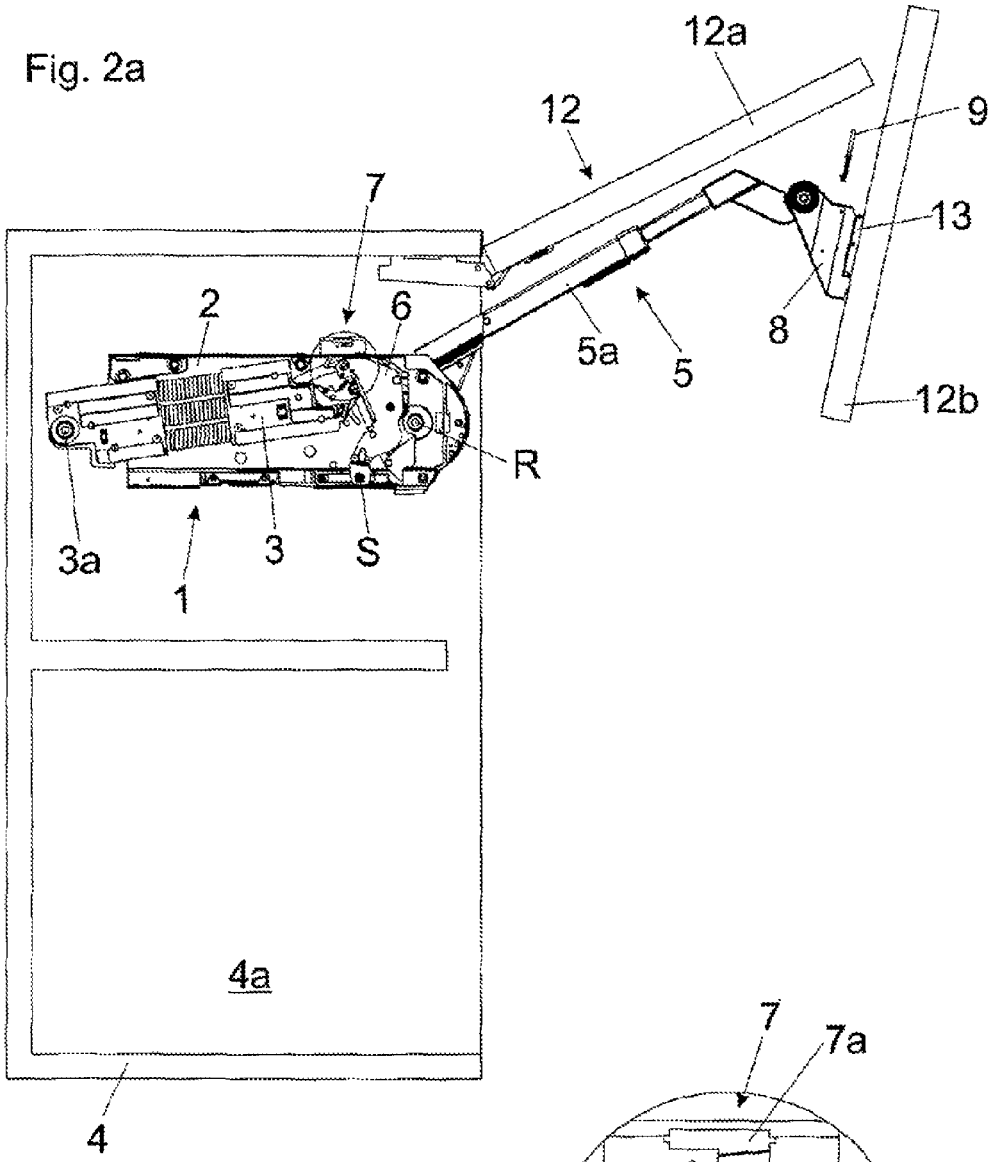
FIGS. 2*a*, 2*b* show the locked actuating device with a furniture flap already fitted to the actuating member, and an enlarged detail view thereof.
Figure 2B:
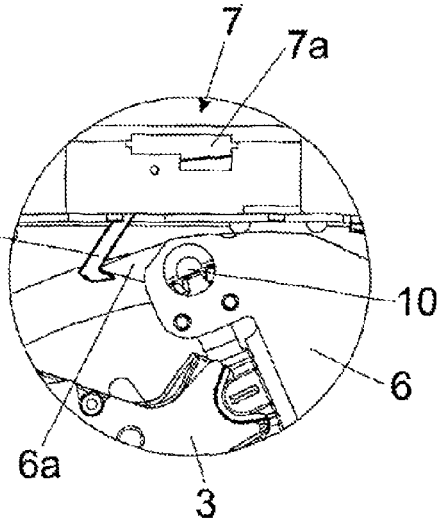

FIG. 2*a* shows the arrangement of FIG. 1*a*, wherein the fixing device 8 of the variable-length actuating arm 5*a* is properly connected to a fitment 13 associated with the furniture flap 12. When therefore the correct connection is made between the fixing device 8 and the fitment 13 at the flap side, the key 9 is also released, as indicated in the Figure. The intermediate lever 6 is still arrested in the illustrated view, but the locking device 7 is releasable from the intermediate lever 6 by the key 9 which has now been released. The flap 12 in the illustrated embodiment is in the form of a two-part flap 12 having flap portions 12*a* and 12*b*. The upper flap portion 12*a* is mounted pivotably relative to the furniture carcass 4 while the lower flap portion 12*b* is mounted pivotably by way of a connecting fitment (not shown) relative to the upper flap portion 12*a*. In the closed position the two flap portions 12*a* and 12*b* assume a vertical position and in so doing substantially completely cover the compartment of the furniture carcass 4. FIG. 2*b* shows a view on an enlarged scale of the region circled in FIG. 2*a* with the locking device 7 in the blocking position, the arresting element 7*c* being latched to an arresting element 6*a* associated with the intermediate lever 6.

Figure 3A:
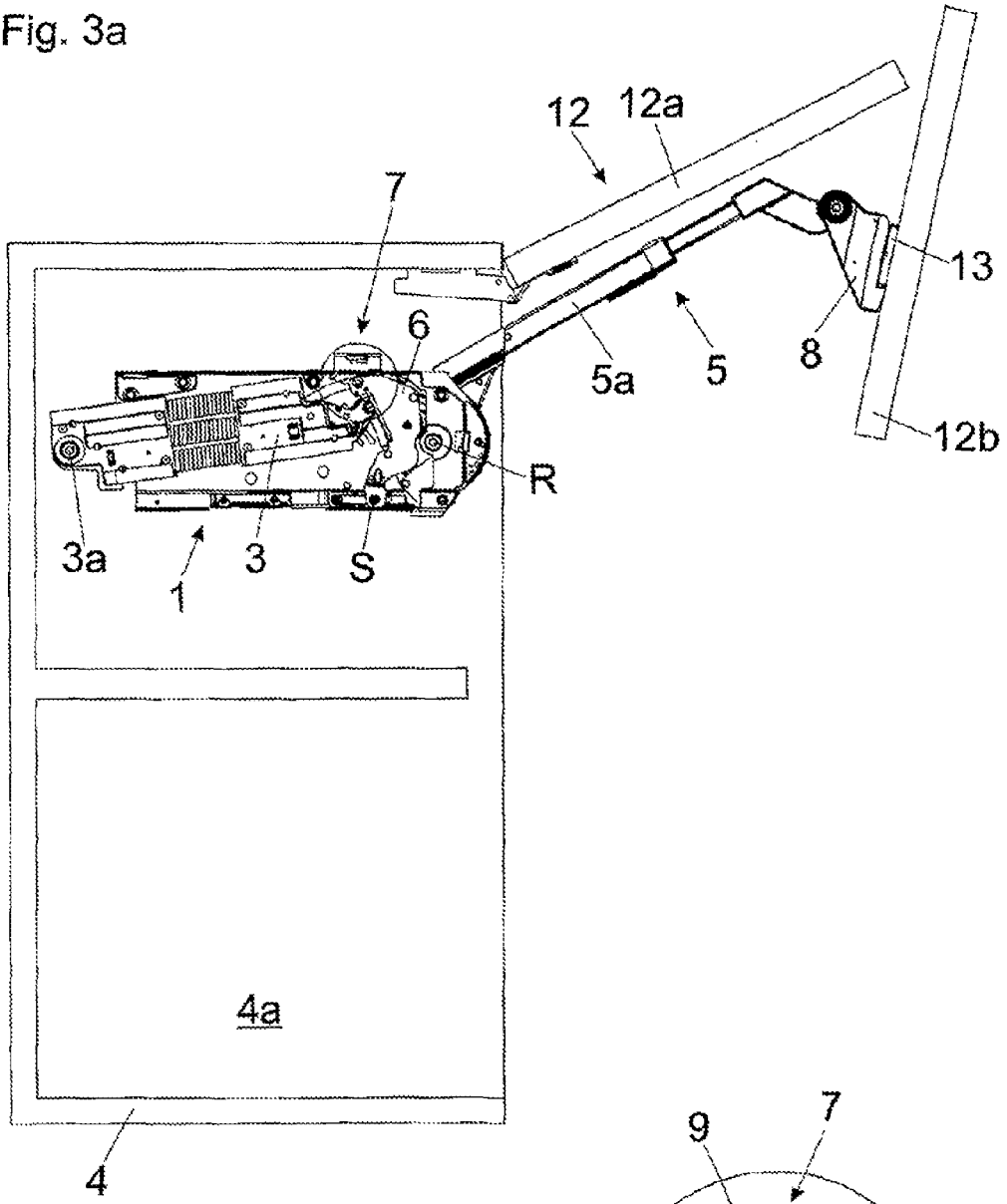
FIGS. 3*a*, 3*b* show the actuating device with a locking mechanism unlockable by a key and an enlarged detail view thereof.
Figure 3B:
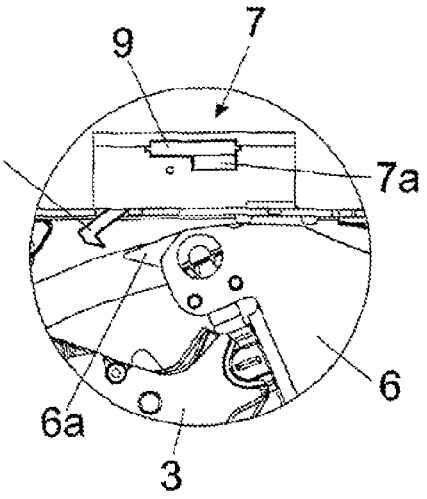

FIGS. 3*a* and 3*b* show the unlocked locking device 7, wherein the key 9 released in FIG. 2*a* has been fitted into the lock 7*a* of the locking device 7. By virtue of the key 9 being fitted into the lock 7*a* of the locking device 7, as shown in FIG. 3*b*, the arresting element 7*c* has been pivoted and released from the arresting portion 6*a* of the intermediate lever 6. The intermediate lever 6 can now be pivoted about axis of rotation S whereby a pivotal movement of the actuating arm 5*a* is also possible again.

Figure 4A:
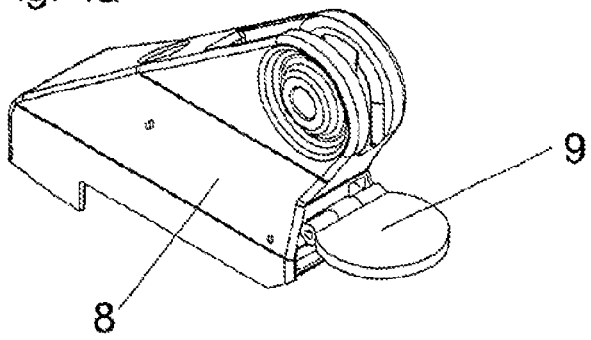
FIGS. 4*a*-4*c* show various views of a fixing device provided for connection to the furniture flap.
Figure 4B:
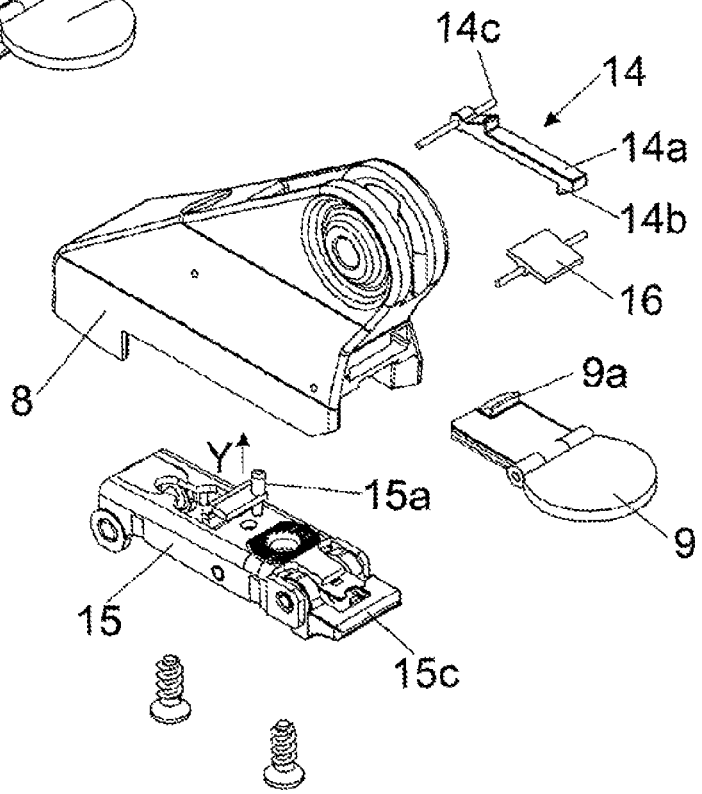
Figure 4C:
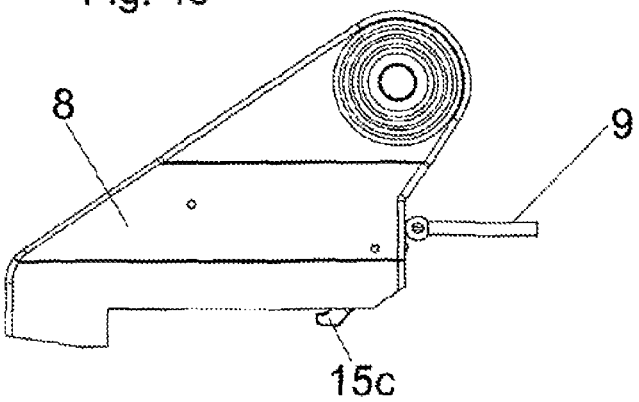

FIG. 4*a* shows a perspective view of the fixing device 8 provided for releasable connection to the fitment 13, at the flap side, which is shown in FIGS. 2*a* and 3*a*. It is possible to see the key 9 which is releasable from the fixing device 8 only after the flap has been fitted. FIG. 4*b* shows an exploded view of the fixing device 8 which has a holding device 14 for the key 9. The holding device 14 includes a movable coupling portion 14*a* having a latching element 14*b* which in the locked position is latched to a corresponding latching element 9*a* of the key 9 so that the key 9 is arrested relative to the holding device 14. It is possible to see a holding element 15 which is associated with the fixing device 8 and which has a displaceably mounted actuating element 15*a* provided for acting on the coupling portion 14*a*. The movable pin-shaped actuating element 15*a* is more specifically urged in the direction of the illustrated arrow Y upon fitment of the flap 12, whereby the coupling portion 14*a* is moved about the axis 14*c* and the latching element 9*a* of the key 9 is released. The holding element 15 includes a support portion 15*c* which is resilient or which is acted upon by a spring and which is latchable to the fitment 13 at the flap side. It is also possible to see a pivotable securing portion 16 which arrests the support portion 15*c* when the key 9 is pulled off. In that way it is not possible to release the support portion 15*c* when the key 9 is pulled out, from the arresting position with the fitment 13 on the flap side. FIG. 4*c* shows a side view of the fixing device 8 with the secured key 9. In a variant of the invention it can also be provided that the key 9 is also secured by way of a releasable holding device 14 at the fitment 13 at the flap side.

Figure 5A:
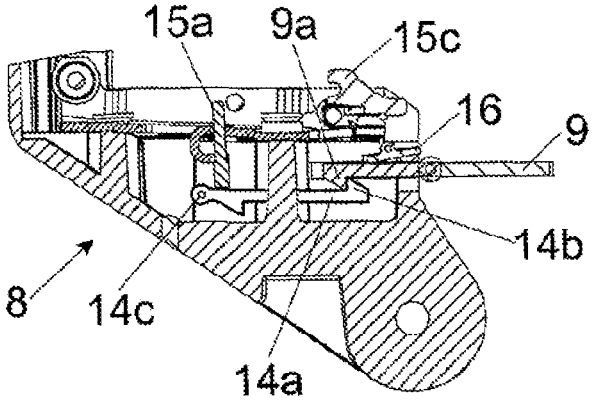
FIGS. 5*a*-5*c* show vertical sections of the fixing device in temporal successions in respect of key unlocking.
Figure 5B:
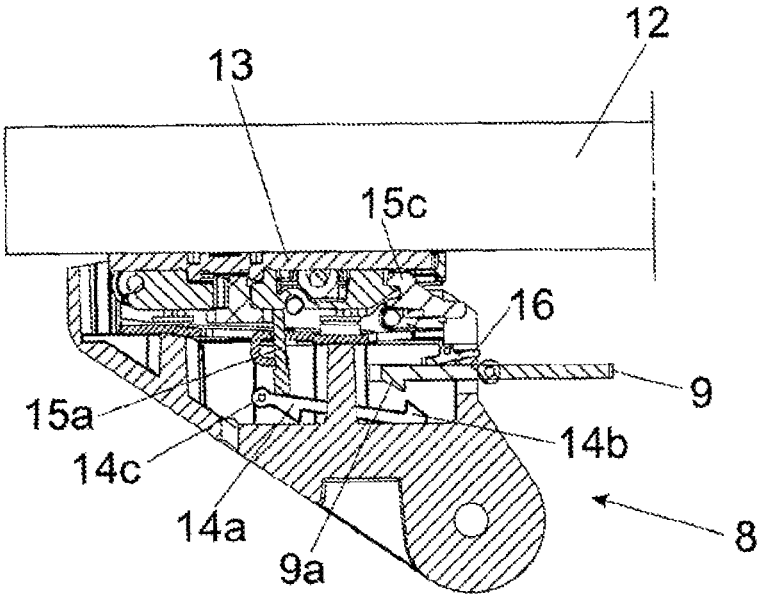
Figure 5C:
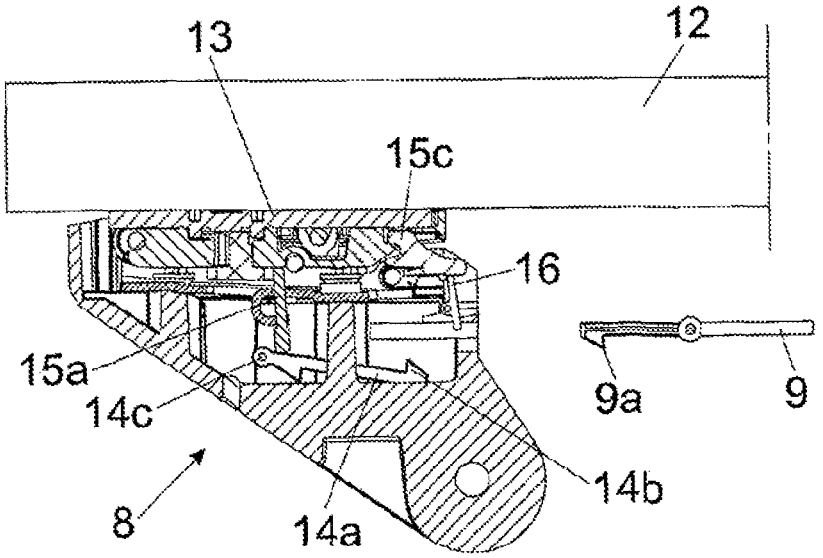

FIGS. 5*a*-5*c* each show vertical sections of the fixing device 8 in temporal successions in respect of key unlocking. It is possible to see the coupling portion 14*a* pivotal about the axis 14*c*. In FIG. 5*a* the latching element 9*a* of the key 9 is in engagement with the corresponding latching element 14*b* of the coupling portion 14*a* so that the key 9 cannot be pulled out. The displaceable, pin-shaped actuating element 15*a* bears against the coupling portion 14*a*. It is possible to see the resilient support portion 15*c* and its securing portion 16 which is in a release position in the illustrated Figure. A flap 12 has not yet been fitted in FIG. 5*a*.

In FIG. 5*b* the fixing device 8 is connected to a flap 12 by way of the fitment 13 at the flap side. The resilient support portion 15*c* is latched with the fitment 13. By virtue of that fitting procedure the actuating element 15*a* is also moved downwardly by a contact surface of the fitment 13 whereby the coupling portion 14*a* has been pivoted about the axis 14*c*. The result of this is that the latching element 14*b* of the coupling portion 14*a* has been unlocked from the latching element 9*a* of the key 9 so that the key 9 can now be pulled out.

FIG. 5*c* shows the withdrawn key 9. In this respect it is also to be stated as a particularity here that after the key 9 has been pulled out of the fixing device 8 the securing portion 16 was pivoted under spring force in the direction of the support portion 15*c* so that manipulation of the support portion 15*c* is not possible. Release of the flap 12 is only possible when the key 9 is inserted into the fixing device 8 again whereby the securing portion 16 is pivoted back again so that the support portion 15*c* is actuable and is movable out of the arresting position with the fitment 13 on the flap side.

Figure 6A:
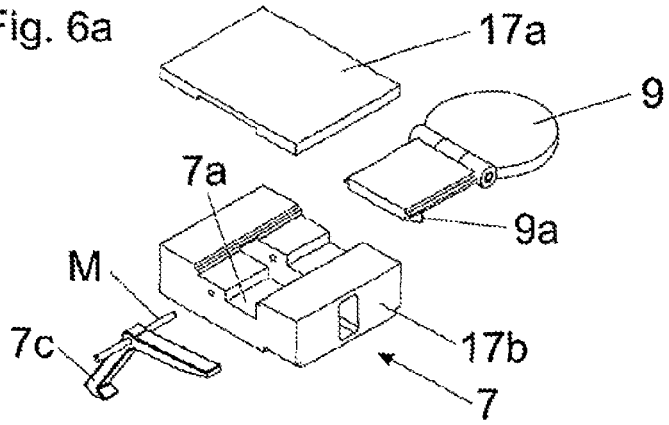
FIGS. 6*a*-6*d* show various views of the locking device arranged in or on the actuating device and provided for arresting an element of the power path of the actuating device, in an arresting position and in a release position.

FIG. 6*a* shows the locking device 7 which can be unlocked by the key 9 and which is or can be arranged on the housing 2 of the actuating device 1. The locking device 7 includes housing portions 17*a* and 17*b*, wherein the lock 7*a* is formed by the intermediate space remaining between the housing portions 17*a*, 17*b*. The arresting element 7*c* is in the form of a double-armed lever pivotable about an axis M. The arresting element 7*c* is acted upon by a spring (not shown) which holds the arresting element 7*c* in the arresting position with the intermediate lever (FIG. 1*b*). When the key 9 is pushed into the lock 7*a* the latching element 9*a* of the key 9 presses against a lever arm of the arresting element 7*c* (FIG. 6*c*) so that the arresting element 7*c* pivots about the axis M and thereby releases the intermediate lever 6.

Figure 6B:
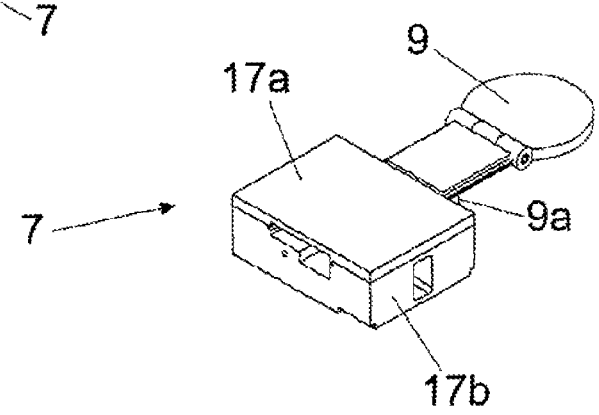
Figure 6C:
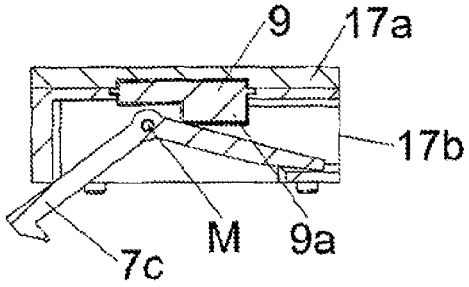
Figure 6D:
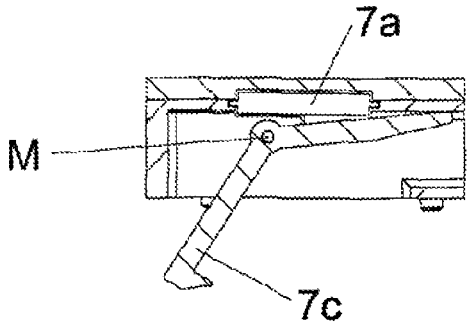

FIG. 6*b* shows the locking device 7 in the assembled condition. FIG. 6*c* shows a vertical section through the locking device 7 with inserted key 9, the latching element 9*a* of which presses against a lever arm of the arresting element 7*c*. The locking action is removed in that position so that the actuating arm 5*a* can move. FIG. 6*d* shows a vertical section with the key 9 removed. FIG. 6*d* shows the empty lock 7*a*, wherein the arresting element 7*c* is automatically urged by spring force in the direction of the arresting position and in the fitted condition blocks an element of the power path of the actuating device 1.

The present invention is not limited to the illustrated embodiment but includes or extends to all technical equivalents which can fall within the scope of the claims appended hereto. The positional references adopted in the description such as for example up, down, lateral and so forth are also related to the directly described and illustrated Figure and are to be appropriately transferred to the new position upon a change in position.

The invention claimed is:

1. A device comprising an actuating device, wherein the actuating device includes:

a housing to be attached to a side wall of a furniture carcass;

a locking device having a lock arranged in or on the housing, the lock having an arresting element;

an actuating member which pivots about an axis of rotation to move a movable furniture part;

a spring device which biases the actuating member to pivot about the axis of rotation in an opening direction, the spring device being arranged in or on the housing; and a transmission mechanism operatively arranged between the spring device and the actuating member to transmit force from the spring device to the actuating member, the transmission mechanism having a movable element;

wherein the locking device and the transmission mechanism are configured such that the arresting element of the lock engages the movable element of the transmission mechanism in a locked position to prevent movement of the movable element and thereby prevent the actuating member from pivoting about the axis of rotation, wherein the locking device and the transmission mechanism are configured such that the lock is unlockable by a key for releasing the arresting element of the lock from engagement with the movable element of the transmission mechanism in an unlocked position to enable movement of the movable element and thereby enable the actuating member to pivot about the axis of rotation, and wherein the locking device and the transmission mechanism are configured such that the arresting element of the lock is engageable with the movable element of the transmission mechanism to prevent the actuating member from pivoting about the axis of rotation while the actuating member is in a completely open position.

2. The device of claim 1, further comprising the furniture carcass and the movable furniture part, wherein the movable furniture part is a flap which is upwardly movable relative to the furniture carcass.

3. The device of claim 1, further comprising the key which unlocks the lock.

4. The device of claim 1, further comprising the key which unlocks the lock, wherein the key is secured in or on the actuating device by a releasable holding device and the releasable holding device releases the key only after fitment of the movable furniture part to the actuating member, and wherein the releasable holding device moves relative to the housing as a result of the actuating member pivoting, and the lock is stationary relative to the housing as the actuating member pivots.

5. The device of claim 4, wherein the releasable holding device has a movable coupling portion by which the key can be arrested, and the movable coupling portion releases the key only after the movable furniture part has been fitted to the actuating member.

6. The device of claim 4, further comprising a fixing device for fixing the movable furniture part, wherein the fixing device is arranged on the actuating member, and wherein the releasable holding device is mounted on or in the fixing device.

7. The device of claim 6, wherein the fixing device includes a holding element and a fitment associated with the movable furniture part, and wherein the releasable holding device is mounted to the holding element or the fitment.

8. The device of claim 7, further comprising a resilient support portion, wherein the holding element and the fitment at the flap side are latchable to each other by way of the resilient support portion.

9. The device of claim 8, further comprising:

a securing portion for the resilient support portion, wherein the securing portion secures the resilient support portion against manipulation in the arresting position when the key is unlocked.

10. The device of claim 1, further comprising the key which unlocks the lock, wherein the key unlocks the locking device only as long as the key is fitted in the lock.

11. The device of claim 1, wherein the actuating member is movable between a closed position and the completely open position, and wherein the actuating member can be arrested by the locking device in the completely open position.

12. The device of claim 1, wherein the actuating device has a power path, and wherein the movable element of the transmission mechanism is in the power path.

13. The device of claim 12, further comprising the furniture carcass and the movable furniture part, wherein the movable furniture part is a flap which is upwardly movable relative to the furniture carcass.

14. The device of claim 12, wherein the arresting element is configured to lock the movable element of the transmission mechanism relative to the housing of the actuating device.

15. An article of furniture comprising at least one actuating device according to claim 1.

16. A device comprising an actuating device, a fixing device, and a key, wherein the actuating device includes:

a housing to be attached to a side wall of a furniture carcass;

a locking device having a lock arranged in or on the housing, the lock having an arresting element;

an actuating member which pivots about an axis of rotation to move a movable furniture part;

a spring device which biases the actuating member to pivot about the axis of rotation in an opening direction, the spring device being arranged in or on the housing; and a transmission mechanism operatively arranged between the spring device and the actuating member to transmit force from the spring device to the actuating member, the transmission mechanism having a movable element;

wherein the locking device and the transmission mechanism are configured such that the arresting element of the lock engages the movable element of the transmission mechanism in a locked position to prevent movement of the movable element and thereby prevent the actuating member from pivoting about the axis of rotation, wherein the locking device and the transmission mechanism are configured such that the lock is unlockable by the key for releasing the arresting element of the lock from engagement with the movable element of the transmission mechanism in an unlocked position to enable movement of the movable element and thereby enable the actuating member to pivot about the axis of rotation, wherein the locking device and the transmission mechanism are configured such that the arresting element of the lock is engageable with the movable element of the transmission mechanism to prevent the actuating member from pivoting about the axis of rotation while the actuating member is in a completely open position, wherein the fixing device is disposed on the actuating member, and the fixing device includes a releasable holding device which holds the key, and wherein the key is held by the releasable holding device and the releasable holding device releases the key only after fitment of the movable furniture part to the actuating member.

17. The device of claim 16, further comprising:

the furniture carcass;

the movable furniture part; and a fitment attached to the movable furniture part, wherein the fitment is releasably connectable to the fixing device, and the releasable holding device releases the key only after the fitment is connected to the fixing device.

18. The device of claim 17, wherein the housing is mounted to the furniture carcass, and wherein the releasable holding device moves relative to the housing as the actuating member pivots, and the lock is stationary relative to the housing as the actuating member pivots.

19. The device of claim 17, wherein the actuating member is movable between a closed position and the completely open position.

* * * * *